United States Patent [19]

Enaka et al.

[11] Patent Number: 4,614,996

[45] Date of Patent: Sep. 30, 1986

[54] CEILING ILLUMINATION APPARATUS

[75] Inventors: Nobuhiro Enaka, Tokyo; Mitsuyoshi Terada, Matsudo; Yoshiro Hashimoto, Yokohama; Shinichi Imabeppu, Matsudo; Kuninori Kobayashi, Hiroshima; Akira Shimamura, Tokyo, all of Japan

[73] Assignees: Shimizu Construction Co., Ltd.; Yamagiwa Corporation, both of Tokyo, Japan

[21] Appl. No.: 756,104

[22] Filed: Jul. 18, 1985

[30] Foreign Application Priority Data

Jul. 19, 1984 [JP] Japan ..... 59-150294
Jul. 19, 1984 [JP] Japan ..... 59-150295

[51] Int. Cl.[4] ..... F21S 1/02; F21V 9/10; F21V 21/02

[52] U.S. Cl. ..... 362/147; 362/231; 362/249; 362/297; 362/404

[58] Field of Search ..... 362/1, 147, 231, 249, 362/253, 297, 298, 367, 404, 405

[56] References Cited

U.S. PATENT DOCUMENTS 2,262,416 11/1941 Winkler ..... 362/1
3,003,055 10/1951 Liberman ..... 362/249
3,299,797 1/1967 Dry ..... 362/147 X
3,379,869 4/1968 Dorman ..... 362/231
4,257,039 3/1981 Webb ..... 362/253 X

FOREIGN PATENT DOCUMENTS 457863 12/1936 United Kingdom ..... 362/298

*Primary Examiner*—Richard E. Gluck
*Attorney, Agent, or Firm*—Armstrong, Nikaido, Marmelstein & Kubovcik

[57] ABSTRACT

A wall of the ceiling has a large number of recessed wall portions formed it in a honeycombed manner, thereby forming projected wall portions between corners of the adjacent recessed wall portions; a plurality of illumination mechanisms for electrically illuminating corresponding recessed wall portions are provided through supporting mechanisms to the ceiling; and ceiling appliances including smoke sensors, and inlets and outlets of an air conditioner. Each supporting mechanism comprises a pipe being connected at one end thereof to a corresponding projected wall portion and at the other end thereof to a corresponding illumination mechanism so that the corresponding illumination mechanism is positioned just below a corresponding recessed wall portion. The ceiling appliances are mounted on the projected wall portions.

4 Claims, 10 Drawing Figures

CEILING ILLUMINATION APPARATUS

BACKGROUND OF THE INVENTION

The present invention relates to an illumination apparatus for illuminating ceilings of buildings.

Usually, ceilings of large buildings are provided with various ceiling appliances such as air inlets and outlets of air conditioners and sprinklers other than lighting equipments. Although these ceiling appliances are indispensable for large buildings but they are liable to disfigure the ceiling. Particularly, in buildings, such as a hotel, where esthetic appearance is important it is a problem in esthetic point of view how to dispose the ceiling appliances.

SUMMARY OF THE INVENTION

Accordingly, it is an object of the present invention to provide a ceiling illumination apparatus which incorporates the ceiling appliances without spoiling the appearance of the ceiling.

With this and other objects in view, the present invention provides a ceiling illumination apparatus of a room in which: a wall of the ceiling has a large number of recessed wall portions formed therein in a honeycombed manner, thereby forming projected wall portions between corners of the adjacent recessed wall portions; a plurality of illumination means for electrically illuminating corresponding recessed wall portions are provided through supporting means to the ceiling; and ceiling appliances including smoke sensors, and inlets and outlets of an air conditioner, wherein each supporting means comprises a pipe being connected at one end thereof to a corresponding projected wall portion and at the other end thereof to a corresponding illumination means so that the the corresponding illumination means is positioned just below a corresponding recessed wall portion; and wherein the ceiling appliances are mounted on the projected wall portions.

DETAILED DESCRIPTION OF THE INVENTION

Figure 1:
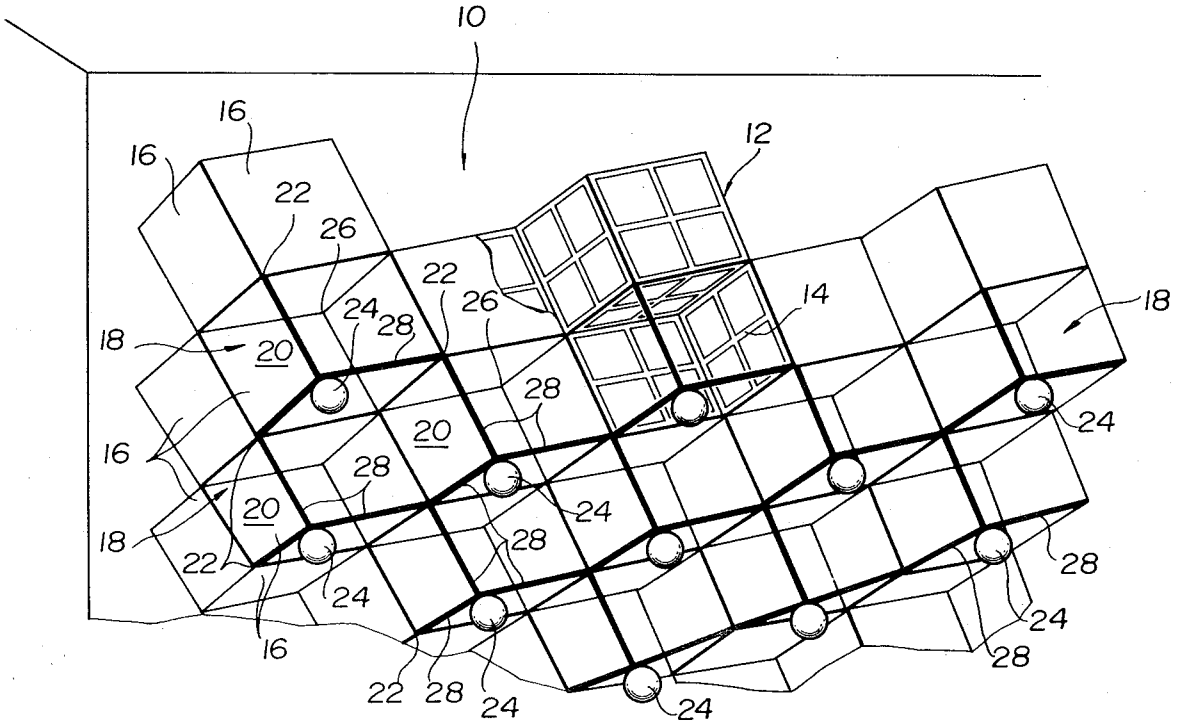
FIG. 1 is a diagrammatical perspective view of a ceiling of a banquet room of a hotel to which is applied a ceiling illumination apparatus according to the present invention.
Figure 2:
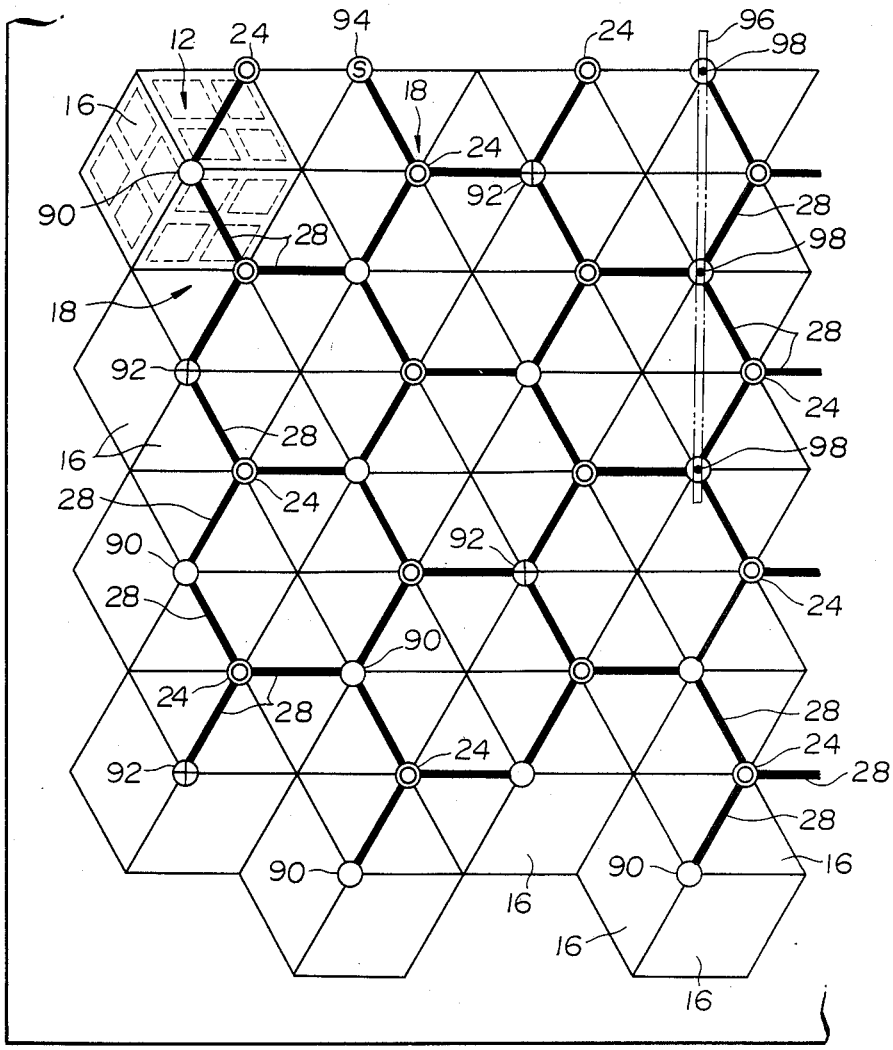
FIG. 2 is a diagrammatical bottom view of the illumination apparatus in FIG. 1.
Figure 3:
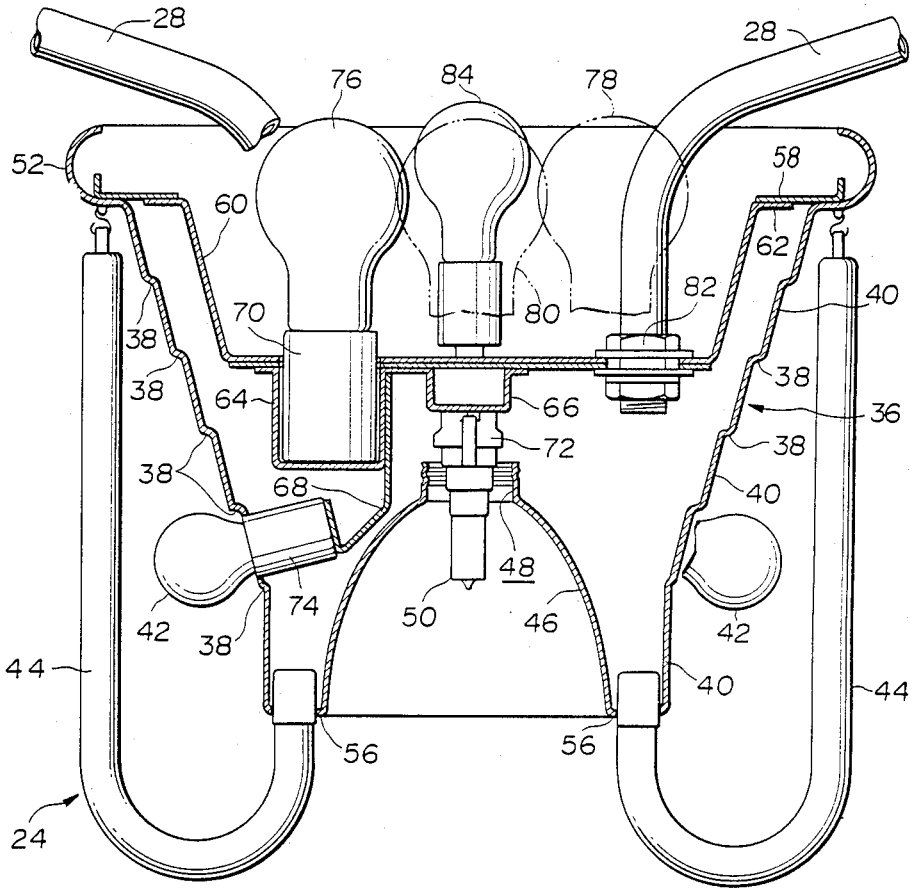
FIG. 3 is an enlarged vertical section of the illumination device used in FIG. 2.
Figure 4:
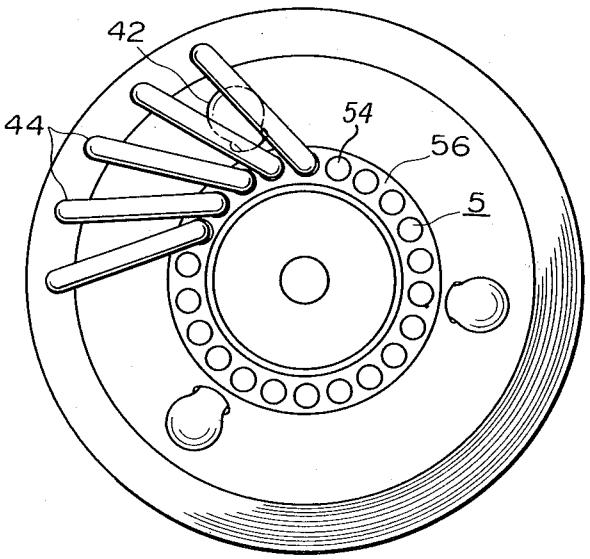
FIG. 4 is a bottom view, in a modified scale, of the illumination device of FIG. 3.
Figure 5:
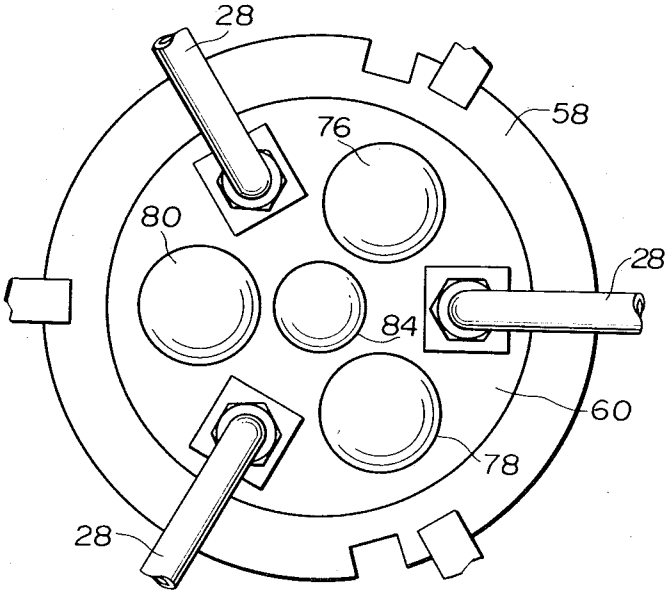
FIG. 5 is a top view of the illumination device in FIG. 4.
Figure 6:
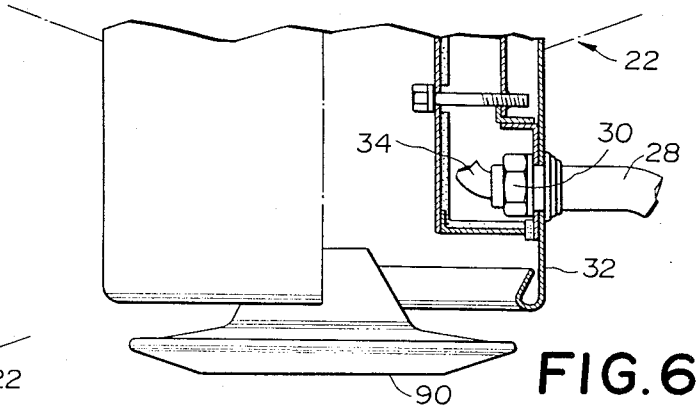
FIG. 6 is a side view, partly in section, of the supporting sleeve in FIG. 2, the supporting sleeve being provided with an air inlet or outlet of an air conditioner.
Figure 10:
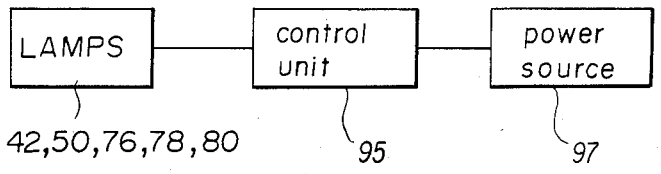
FIG. 10 is a block diagram illustrating electric connections of the electric lamps in FIG. 3 through a controlling unit to an electric power source.

In FIGS. 1 and 2, 10 designates a ceiling of a hotel lobby. The ceiling 10 is provided with a honeycombed ceiling framework 12 having a large number of frame cells 14 although only one frame cell 14 is illustrated in FIGS. 1 and 2. Each frame cell 14 forms three adjacent faces of an equilateral parallelopiped, in this embodiment, cube. Over each frame cell 14 three rhomboid, square in this embodiment, ceiling wall elements 16 are secured with screws to form a ceiling wall unit 18. Each ceiling wall unit 18 forms three faces of a cube. Thus, there are alternatively formed a large number of recesses 20 and projections 22 both having a hexagonal shape in bottom view as shown in FIG. 2 and hence the ceiling 10 is provided with a honeycombed face. In this embodiment each ceiling wall element 16 is a plasterboard having a rough white surface for irregularly reflecting light of all colors. Reference numeral 24 indicates an illumination device arranged to correspond to each wall unit 18. Each illumination device 24 is supported just below the center 26 of the corresponding wall unit 18 by distal ends of three pipes 28. The proximal ends of the three pipes 28 are, as shown in FIG. 6, each fastened with nut 30 to a supporting sleeve 32 fixed to an apex of the projection 22 through a hanging bolt now shown. An electric wire 34 is inserted through each pipe 28 for supplying an electric power to the illumination unit 24. Each illumination unit 24 includes, as shown in FIGS. 3–5, a generally funnel-shaped reflector 36 having five coaxial, annular shoulders 38 formed in it to circumferentially extend around it. Thus, six reflection rings 40 are formed by the shoulders 38 for reflecting light from electric sub-lamps 42, secured to a lower portion of the reflector 36 so that every portion of J-shaped glass bodies 44 are illuminated from inside. The smallest-diameter portion of the reflector 36 is inwardly bent to form a concave reflector 46. The concave reflector 46 has an opening 48 formed at its top portion for receiving a main electric lamp 50 for directly lighting the room. The upper edge of the funnel-shaped reflector 36 is inwardly bent to form a curled edge 52. Each glass body 44 is suspended at its stem from the curled edge 52 of the funnel-shaped reflector 36 and fitted at the tip of its hook portion into a hole 54 formed through the lower edge 56 of the funnel-shaped reflector 36. The glass bodies 44 are, as shown in FIG. 4, arranged at regular angular intervals around the concave reflector 46. A supporting ring 58 is coaxially secured to the inner face of the curled edge 52 of the funnel reflector 36. The supporting ring 58 has a bowl-shaped reflector 60 screwed at its upper flange 62 to the inner periphery thereof so that the bowl-shaped reflector 60 opens upwards. The bowl-shaped reflector 60 is provided at its bottom with attachments 64–68 for attaching sockets 70–74 for electric lamps 76–80, 50 and 42, respectively. The proximal end of each supporting pipe 28 is bent towards the bottom of the bowl-shaped reflector 60 and fastened there by means of nuts 82 and 82.

Above the bottom of the bowl-shaped reflector 60, there are provided at the center thereof with an electric lamp 84 for emitting white light and at regular angular intervals around the white light lamp 84 with three primary color lamps 76–80 for emitting red, blue and green lights respectively. These lamps 76–84 are adjusted in strength in a correlated manner by means of a controlling unit 95 (FIG. 10) including a computer not shown so that the surfaces of the corresponding wall unit 18 may be illuminated with a desired color and illuminance. In each illumination unit 24, the white light lamp 84 and three primary color lamps 76-80 can be separately adjusted in illuminance. Theoretically, white light is produced by superposing three primary colors, but in practice it is difficult to obtain white light by doing so because of fluctuation in voltage, quality difference in the primary color lamps 76–80, etc. The lamps 42, 50, 76, 78, 78 84 are electrically connected through the control unit 95 to an electric power source 97.

Figure 7:
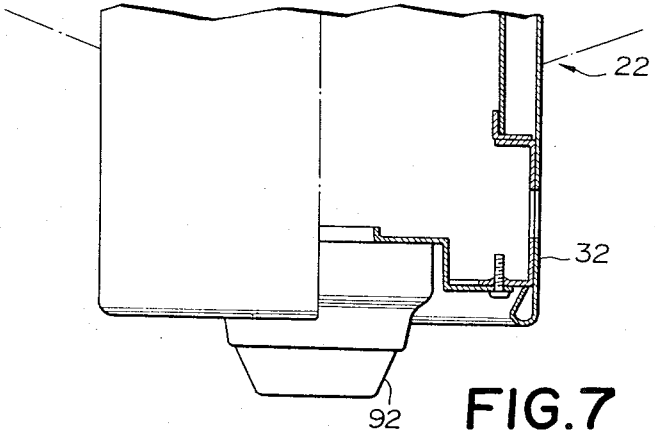
FIG. 7 is a side view, partly in section, of another supporting sleeve in FIG. 2, the supporting sleeve being provided with a smoke detector.
Figure 8:
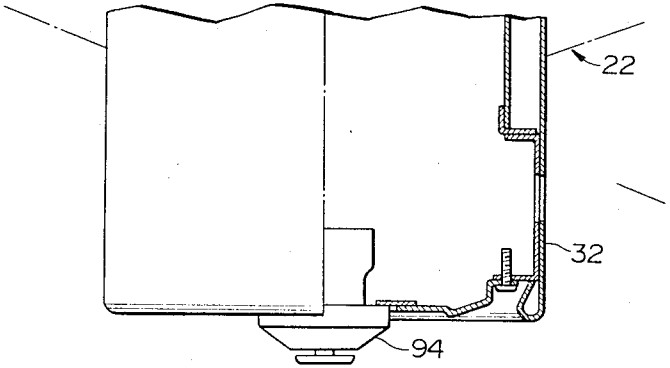
FIG. 8 is a side view, partly in section of still another supporting sleeve in FIG. 2, the supporting sleeve being provided with a sprinkler.

The supporting sleeves 32 are attached to the framework of the ceiling through attachments not shown, such as hanging bolts. The supporting sleeves 32 serve to support various room appliances as well as the illumination units 24. As shown in FIG. 2, such appliances include, for example, air inlets and outlets 90 for air conditioner, sprinklers 92 and smoke detectors 94. These appliances are, as illustrated in FIGS. 6–8, attached to the lower end portions of the supporting sleeves 32 with attachments such as machine screws. These parts 90–94 are disposed to be distributed in predetermined intervals and hence, may also serve as ornaments. Reference numeral 96 designates a bar for hanging flags, etc, which is suspended from the ceiling 10 by ropes 98 passing through the supporting sleeves 32.

With such a construction, light emitted from the main lamp 50 and from the sub-lamps 42 is respectively reflected by the reflector 46 and the outer faces of the reflector 36 and directed only toward the floor. Thus, these lamps 42 and 50 give only small influence on the lighting of the white light lamp 84 and the primary color lamps 76, 78 and 80 to the ceiling 10.

In illuminating the whole ceiling with white light, only the white light lamps 84, disposed above the bowl-shaped reflectors 60, are turned on and the other lamps 76, 78 and 80 are turned off by means of the control unit 95. By this operation, every ceiling wall unit 18 is lighted with white light and hence the whole ceiling 10 is illuminated with white light.

In lighting the whole ceiling 10 with any of the primary colors, i.e., red, green and blue, operations are carried out by the control unit 90 so that only lamps 76, 78 or 80, which emit the desired color of light, are turned on and the other lamps are turned off. Thus, all the ceiling wall units 18 are lit with any desired one of the primary colors.

To light the whole ceiling 10 with any intermediate color different from the primary colors, primary color light lamps 76, 78 and 80 for each illumination unit 24 are separately adjusted in current suppled and thereby luminous energy from each primary color light lamp is adjusted. Thus, different colors of light from the three primary color light lamps 76, 78 and 80 of each unit 24 are superposed and hence every ceiling unit 18 is lit with the desired intermediate color of light.

Figure 9:
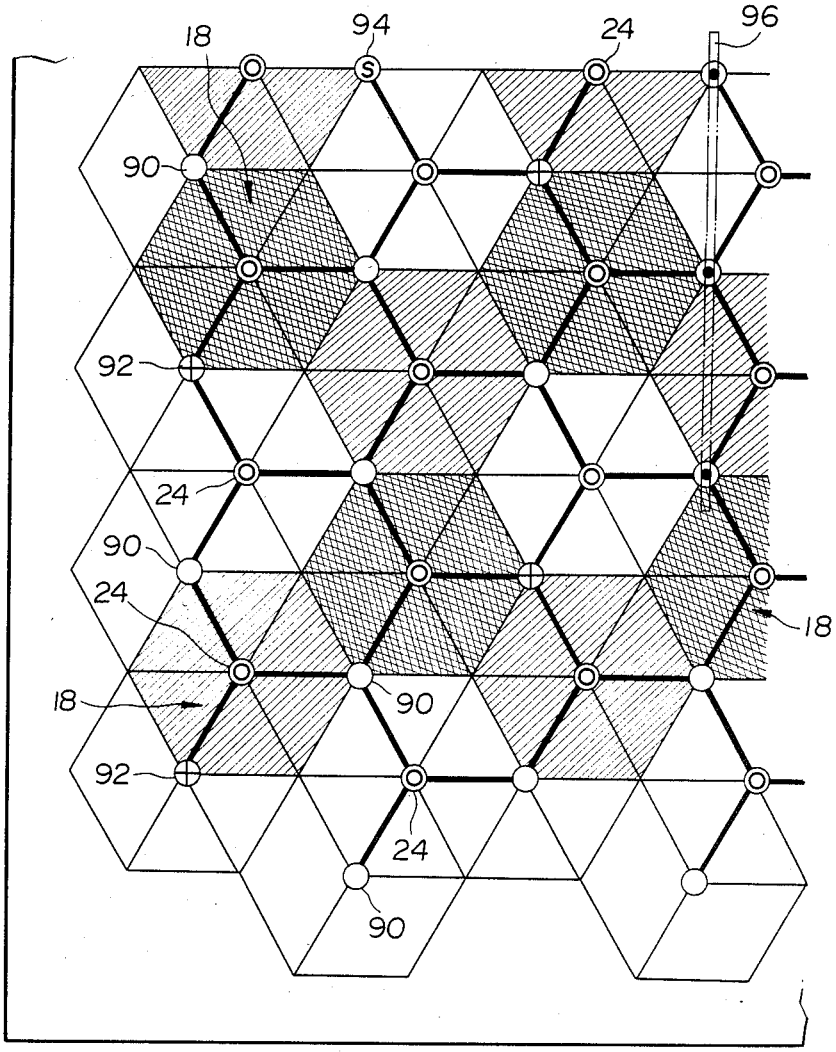
FIG. 9 is a diagrammatical bottom view, in a modified scale, of the ceiling shown in FIG. 1, illustrating a mode of operation of the illumination device.

Further, the wall units 18 may be illuminated with different, desired colors of light and thereby a picture may be painted on the whole ceiling 10 by using the wall units 18 as picture elements. For this, the which light lamps 84 and the primary color light lamps 76, 78 and 80 are separately controlled in current supplied by the control unit 95 for each illumination unit 24. Thus, the three primary color light lamps 76, 78 and 80 and the white light lamp 84 of each illumination unit 24 are separately adjusted in luminous energy emitted so that the ceiling wall units 18 are lit with any different desired colors and luminous flux densities and thereby a picture may be painted on the ceiling 10 as shown in FIG. 9.

For varying in color and strength the light illuminating the ceiling units 18 or for changing the picture on the ceiling 10 to another picture, current supplied to the white light lamp 84 and the primary color light lamps 76, 78 and 80 may be instantaneously or gradually changed in level and thereby esthetic effects may be achieved by changing the colors of the ceiling 10. Further, the ceiling wall 10 may be used as a display device serving like a cathode ray tube of a television set.

Although the ceiling wall unit 18 is formed in a hexagonal shape when viewed from the bottom, but may be formed in other desired shapes, for example, triangle in bottom view.

The primary color lamps 76, 78 and 80 and white light lamp 84 are not necessarily used but only one of the primary color lamps or white light lamp may be adopted The present invention may be of course applied to ceilings of other various rooms.

What is claimed is:

1. In a ceiling illumination apparatus of a room in which: a wall of the ceiling has a large number of recessed wall portions formed therein in a honeycombed manner, thereby forming projected wall portions between corners of the adjacent recessed wall portions; a plurality of illumination means for electrically illuminating corresponding recessed wall portions are provided through supporting means to the ceiling; and ceiling appliances including smoke sensors, and inlets and outlets of an air conditioner, the improvement wherein:

each supporting means comprises a pipe being connected at one end thereof to a corresponding projected wall portion and at the other end thereof to a corresponding illumination means so that the the corresponding illumination means is positioned just below a corresponding recessed wall portion; and wherein the ceiling appliances are mounted on the projected wall portions.

2. A ceiling illumination apparatus as recited in claim 1, wherein: the projected wall portions of the ceiling wall each comprises a supporting sleeve perpendicularly mounted thereon; the one end of each pipe is secured to a supporting sleeve mounted on a corresponding projected portion; each illumination means comprises an electric wire passing through both the corresponding pipe and supporting sleeve for electrically connecting the illumination means to an electric power source; and the ceiling appliances are mounted on the supporting sleeves.

3. A ceiling illumination apparatus as recited in claim 2, each illumination means comprises: an upper reflector formed by downwardly recessing an upper portion thereof; a plurality of electric color lamps for emitting different colors of light, the electric color lamps being disposed within the upper reflector and below the periphery of the upper reflector so that light emitted from the electric lamps is projected on the corresponding recessed wall portion; a lower reflector formed by upwardly recessing a lower portion thereof; and a main electric lamp disposed in the lower reflector so that light emitted from the main lamp is reflected downwards by the lower reflector.

4. A ceiling illumination apparatus as recited in claim 3, wherein each illumination means comprises: a downwardly converging frustoconical reflector; a plurality of glass bodies mounted on a circumferential face of the frustoconical reflector so as to be suspended around the circumferential face; and a plurality of electric sub-lamps, mounted on the circumferential face of the frustoconical reflector, for lighting the glass bodies, whereby light emitted from the sub-lamps is downwardly reflected by the circumferential face of the frustoconical reflector, and wherein the upper reflector is provided in an upper opening of the frustoconical reflector and the lower reflector is provided in a lower opening of the frustoconical reflector.

* * * * *